United States Patent [19]

Shaw

[11] 4,145,826

[45] Mar. 27, 1979

[54] DISPLAY HOLDER FOR DISPLAYING A PLATE OR THE LIKE

[76] Inventor: Lawrence Shaw, P.O. Box 95, Sausalito, Calif. 94965

[21] Appl. No.: 792,812

[22] Filed: May 2, 1977

[51] Int. Cl.[2] ..... G09F 19/00

[52] U.S. Cl. ..... 40/152; 40/10 D

[58] Field of Search ..... 40/156, 152.1, 152, 40/10 D, 209, 610, 125 H

[56] References Cited

U.S. PATENT DOCUMENTS

| | | | |
|---|---|---|---|
| 1,905,874 | 4/1933 | Hudson | 40/209 |
| 2,171,713 | 9/1939 | Roose | 40/209 |
| 3,877,162 | 4/1975 | Wilson | 40/152.1 |
| 3,963,289 | 6/1976 | Pralle | 40/10 D X |
| 4,014,119 | 3/1977 | Teufel | 40/156 |

FOREIGN PATENT DOCUMENTS

| | | | |
|---|---|---|---|
| 5900 | 2/1932 | Australia | 40/209 |

*Primary Examiner*—John F. Pitrelli
*Assistant Examiner*—G. Lee Skillington
*Attorney, Agent, or Firm*—Gordon Wood

[57] ABSTRACT

A display holder for a decorative article such as a plate. A frame is provided having front and rear walls between which the plate is inserted and positioned against the inner side of the front wall. The front wall is apertured to permit viewing of the plate therethrough and means on the rear wall is provided for supporting the plate in a vertical position at three points. The frame is preferably formed of transparent plastic to enhance the appearance and utility of the same and to permit ready assembly by adhesives or sealants. In the preferred form of the invention the means for holding the plate are adjustable to permit use with plates of different sizes and different contours.

4 Claims, 4 Drawing Figures

DISPLAY HOLDER FOR DISPLAYING A PLATE OR THE LIKE

This invention relates to a display holder for displaying an article such as a plate or the like.

It is popular to display decorative plates which in many instances include artistic works on their front sides. Displaying such plates on a ledge, shelf or the like tends not to emphasize the aesthetic character of the article and, in addition, increases the chances of accidental breakage.

The main object of the present invention is the provision of a display holder or display frame for plates and similar articles designed so as to enhance the appearance and promote safety.

Another object of the invention is the provision of a display holder for plates and like articles which is arranged so that no supports or holding elements can be seen by the viewer.

Another object of the invention is the provision of a display holder which is particularly adapted for use with decorative plates and which includes adjustable means to permit displaying plates of different sizes and different contours. Other objects will be apparent from the following specification and from the drawing.

Figure 1:
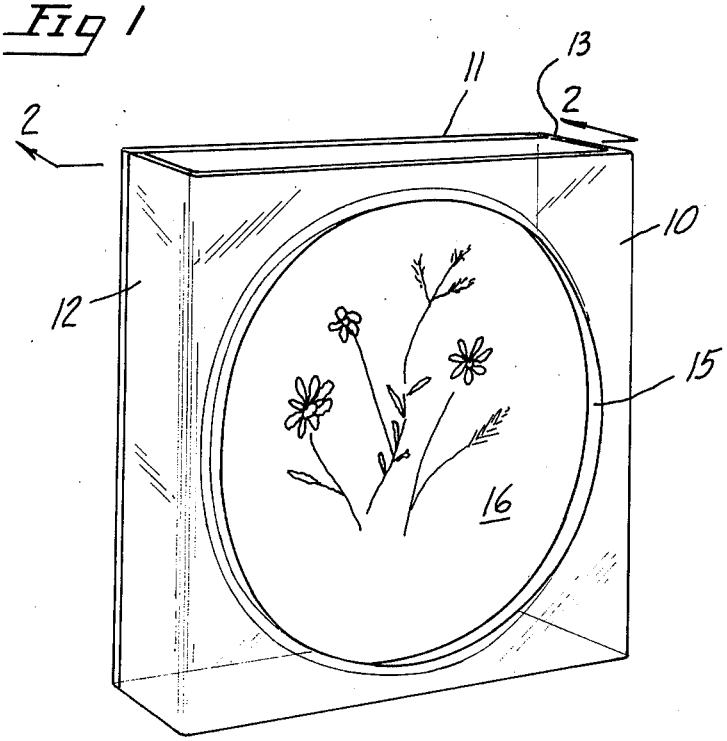
FIG. 1 is a perspective of the invention showing a plate mounted thereon.
Figure 2:
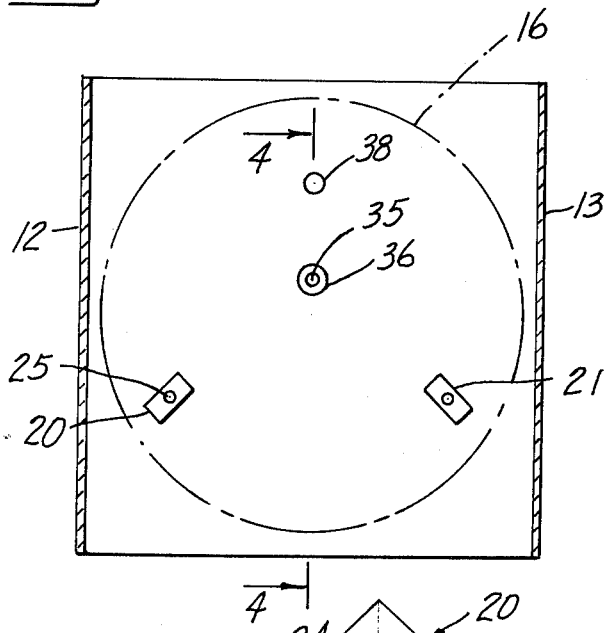
FIG. 2 is a vertical cross section through the holder as taken in a plane indicated by lines 2—2 of FIG. 1.

In detail, and first with reference to FIG. 1, the frame is formed with a front wall 10, a rear wall 11 horizontally spaced apart from and parallel to front wall 10, and a pair of side walls 12, 13. The frame is open at the bottom and at the top.

It is preferable to form the front wall 10 and side walls 12, 13 from one sheet of transparent plastic such as an acrylic. Such sheet may be bent to a channel shape as indicated in FIG. 1 and the rear wall 11 may be adherently secured to the free edges of side walls 12, 13 by means of a suitable adhesive or sealant. The front wall 10 is preferably provided with a relatively large diameter opening 15 to permit viewing the plate 16 or other article therethrough.

Plate 16 is held in the desired position concentric with the opening 15 by means of a pair of abutments 20, 21 carried by the rear wall 11. Said abutments may be fixedly secured to said rear wall 11 to suit popular plates having standardized diameters and rear wall contours. However, such abutments are preferably provided with a central aperture 24 which is internally threaded to receive a screw 25 therethrough. In this manner the abutments are rotatably supported on the screw and at the same time may be tightly secured by friction by tightening screws 25 when the article is in the desired position.

Figure 3:
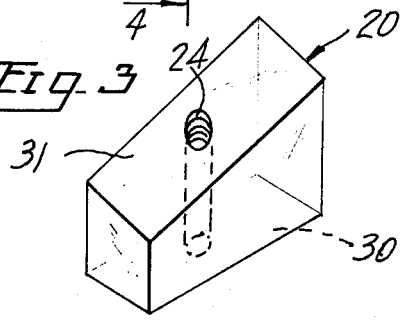
FIG. 3 is a perspective of one of the abutment elements.
Figure 4:
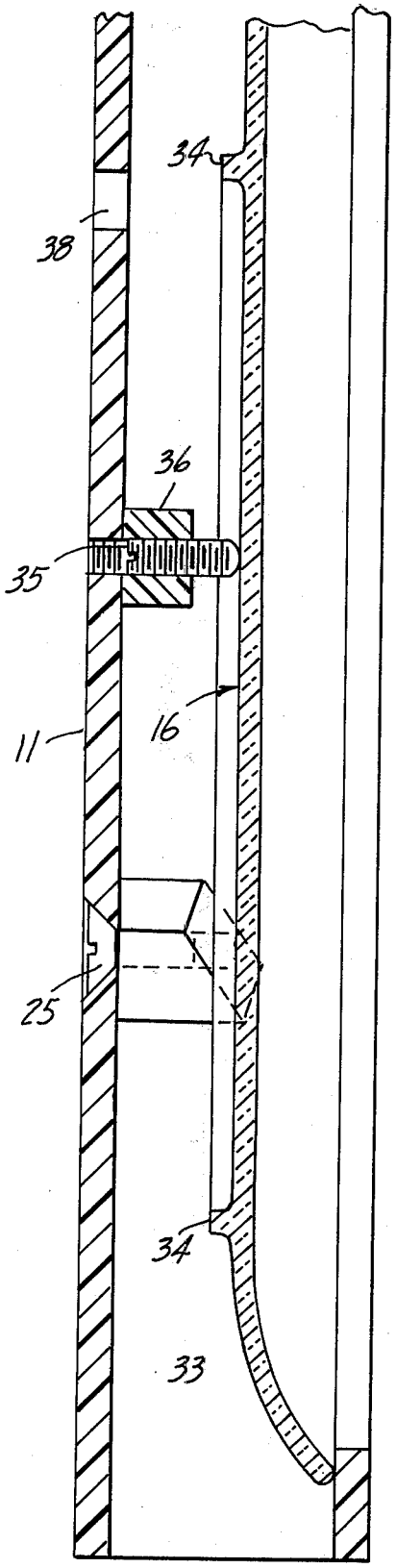
FIG. 4 is a greatly enlarged fragmentary transverse sectional view taken in a plane indicated by lines 4—4 of FIG. 2.

As best seen in FIG. 3 each abutment 20, 21 may be formed from a block of transparent plastic to provide a rectangular face 30 which is adapted to engage the inner side of rear wall 11 and an opposite wall 31 which is slantingly disposed relative to side 30 so as to slant in two directions as indicated in FIG. 3. By this structure when the plate 16 is concentric with opening 15 in front wall 10 the abutment elements 20, 21 may be adjusted so as to engage the slanting surface formed on the peripheral margin of most plates. Such surface is indicated at 33 in FIG. 4. At the same time said abutments 20, 21 may engage the annular ridge 34 which is ordinarily provided on most plates to support the plate on a flat surface.

After the plate has been positioned as noted above a set screw 35 may be tightened against the rear side of the plate at a point inwardly of the annular ridge 34 and preferably slightly above the center of the plate. This set screw is received within a solid housing 36 which is adherently secured to the inner side of the rear wall 11. A hole is provided through said rear wall and the housing 36 and tapped to receive the set screw 35.

In order to permit the frame to be supported on a nail or like hanger the rear wall 11 is apertured as at 38 to permit hanging the assembly on a hanger is desired.

By the above described structure it will be seen that not only is an attractive frame provided for the decorative plate, but the identifying indicia on the bottom of the plate may be inspected through the rear wall 11 without dismantling the assembly. Furthermore, in the event the abutment elements 20, 21 fail in some manner the plate 16 will still be held by the frame since, in such a case, the screw 35 will engage the annular ridge 34 preventing the plate from falling through the open bottom.

It will be apparent that the frame may be formed in different sizes to suit the size of the article to be displayed, but it will also be noted that plates of slightly differing diameters and contours may be accomodated by the same frame.

I claim:

1. A display holder for displaying a dish-shaped plate article comprising:

a frame having spaced apart generally vertically extending front and rear walls, said front wall being formed with an opening for viewing the front side of such article therethrough when such article is positioned against the inner side of said front wall, a pair of abutment elements carried by said rear wall and adapted to engage the rear side of such article at horizontally spaced apart points along the lower portion of said article when such article is so positioned, a third abutment element interposed between and above said pair of abutments and adjustably secured relative to said rear wall for movement toward and away from the latter and into abutment with the rear side of said article, each of said pair of abutment elements is a block having one side adapted to engage the inner face of said rear wall and an opposite side slantingly disposed relative to said one side to register with the contour of the rear side of side article, said third abutment element comprises a screw, a housing adherently secured to the inner face of said rear wall and internally threaded to receive said screw therein, and an aperture in said rear wall to provide access to said screw.

2. A display holder according to claim 1 wherein a pair of threaded elements are passed through said rear wall and into threaded engagement with said pair of abutment elements to permit said abutments to be rotated for adjustably positioning the same relative to said article.

3. A holder according to claim 1 wherein said rear wall is apertured at a point above said third abutment to permit hanging said holder on a hanger.

4. A holder according to claim 1 wherein said holder includes a pair of relatively narrow side walls integral with said front wall and adherently secured to the vertical marginal portions of said rear wall.

* * * * *